US005823407A

United States Patent [19]

Mayer et al.

[11] Patent Number: 5,823,407

[45] Date of Patent: Oct. 20, 1998

[54] SECURITY GARMENT HANGER

[75] Inventors: Gerhard Joachim Mayer, 2 Wordsworth, St. Kilda, Victoria 3182; Allan James Hooworth, Hawthorn, both of Australia

[73] Assignees: Erich Johannes Unterwurzacher; Gerhard Joachim Mayer; Thomas Alfred Weisler, all of, Australia

[21] Appl. No.: 836,676

[22] PCT Filed: Nov. 3, 1995

[86] PCT No.: PCT/AU95/00732

§ 371 Date: Apr. 30, 1997

§ 102(e) Date: Apr. 30, 1997

[87] PCT Pub. No.: WO96/14487

PCT Pub. Date: May 17, 1996

[30] Foreign Application Priority Data

Nov. 4, 1994 [AU] Australia ..... PM9270

[51] Int. Cl.[6] ..... A47G 25/14; E05B 69/00

[52] U.S. Cl. ..... 223/85; 223/93; 70/59; 70/62

[58] Field of Search ..... 223/85, 88, 92, 223/93, 89, 90, 91; 70/59, 62

[56] References Cited

U.S. PATENT DOCUMENTS

| | | | |
|---|---|---|---|
| D. 134,980 | 2/1943 | Benner . | |
| 1,373,112 | 3/1921 | Backus . | |
| 1,470,925 | 10/1923 | Klein et al. . | |
| 1,563,660 | 12/1925 | Rubin | 223/93 |
| 1,636,264 | 7/1927 | Weiss | 223/93 |
| 1,705,276 | 3/1929 | Weiss | 223/93 |
| 2,328,142 | 8/1943 | Hanauer | 223/87 |
| 2,441,407 | 5/1948 | Glavies | 223/91 |
| 2,476,524 | 7/1949 | Allen | 223/93 |
| 3,229,871 | 1/1966 | Capo | 223/91 |
| 3,543,941 | 12/1970 | Gorman | 211/4 |
| 4,324,352 | 4/1982 | Goldfarb et al. | 223/91 |
| 4,460,092 | 7/1984 | Michaelina . | |
| 4,615,447 | 10/1986 | Walter | 70/59 |
| 4,951,484 | 8/1990 | Robald et al. | 70/59 |
| 5,011,054 | 4/1991 | Mauffette | 223/85 |

FOREIGN PATENT DOCUMENTS

| | | |
|---|---|---|
| 143578 | 9/1951 | Australia . |
| 52689/86 | 7/1987 | Australia . |
| 2439575 | 5/1980 | France . |
| 2442324 | 7/1980 | France . |
| 1579496 | 8/1920 | Germany . |
| 359661 | 9/1922 | Germany . |
| 163192 | 5/1956 | Sweden . |
| 180012 | 11/1959 | Sweden . |
| 175600 | 3/1935 | Switzerland . |
| 470570 | 3/1969 | Switzerland . |
| 240746 | 9/1979 | Switzerland . |
| WO90/13247 | 11/1990 | WIPO . |

*Primary Examiner*—Bibhu Mohanty
*Attorney, Agent, or Firm*—Arnold White & Durkee

[57] ABSTRACT

A security garment hanger (2) having a central body portion (4) formed with a hook (14) and a garment clamping arm (24) which operates to clamp a garment to the body portion, the garment hanger includes a hook closure member (18) and a combination lock (40), the arrangement being such that the combination lock (40) needs to be opened before the hook closure member can be opened to permit removal of the hanger from a hanging rail (30) and wherein, opening of the hook closure member (18) also permits opening of the garment clamping arm (24) so that the garment can be removed from the hanger.

15 Claims, 10 Drawing Sheets

SECURITY GARMENT HANGER

This invention relates to a garment hanger.

More particularly, the invention relates to a security garment hanger which can be used in situations where theft or shop lifting is a problem such as in retail outlets and the like.

The general object of the invention is to provide a security guard coat hanger which provides good security, is of attractive appearance and which is of simple and robust construction.

According to the present invention there is provided a security garment hanger comprising a hanger body including suspension members upon which a garment can be hung, a hook member for suspending the body from a rail or the like, said garment hanger including a closure member which is movable relative to the hanger body between an open position in which the hook member can be coupled to or uncoupled from said rail and means for preventing removal of the garment from the suspension members.

When the closure member is closed, the garment cannot be removed from the hanger and the hanger itself cannot be removed from the rail. This therefore provides a measure of security against shop lifting in retail outlets.

Preferably, the closure member is mounted for sliding movement relative to the hanger body.

Alternatively the closure member is mounted for rotary movement relative to the hanger body.

Preferably the closure member is mounted for both sliding and rotary movement relative to the hanger body.

Preferably the closure member interlocks with the closure member when in its closed position.

Preferably further, the means for retaining the garment on the suspension members comprises a retaining member which clamps against the garment.

Preferably the garment hanger includes a retaining member release mechanism for controlling opening and closing movements of the retaining member.

Preferably the release mechanism is coupled to the closure member, the arrangement being such that when the closure member is in its closed position, the release mechanism holds the retaining member in its closed position clamping the garment to the suspension members. When the closure member is moved to its open position, the closure member activates the release mechanism so that the retaining member can move to its open position whereby the garment can be removed from the suspension members.

Preferably further, the garment hanger includes locking means for selectively locking the closure member in its closed position. The locking means may comprise a lock which controls sliding movement of the closure member. In the preferred form of the invention, the locking means comprises a combination lock.

The invention also provides a security garment hanger comprising a body portion, hook extending from the body portion, garment clamping means mounted for movement between an open position and a clamped position in which in use a garment is clamped between the garment clamping means and the body portion, a hook closure member which is mounted for rotational movement relative to the body portion from a closed position in which a first part of the hook closure member engages or is adjacent to the hook and an open position in which the first part of the hook closure member is clear of the hook whereby, in use, the hook can be removed from a hanging rail, a lock for locking the hook closure member in its closed position, and interlocking means operable whilst the hook closure member is in its closed position to retain the garment clamping means in its clamped position.

The invention will now be further described with reference to the accompanying drawings, in which.

Figure 1:
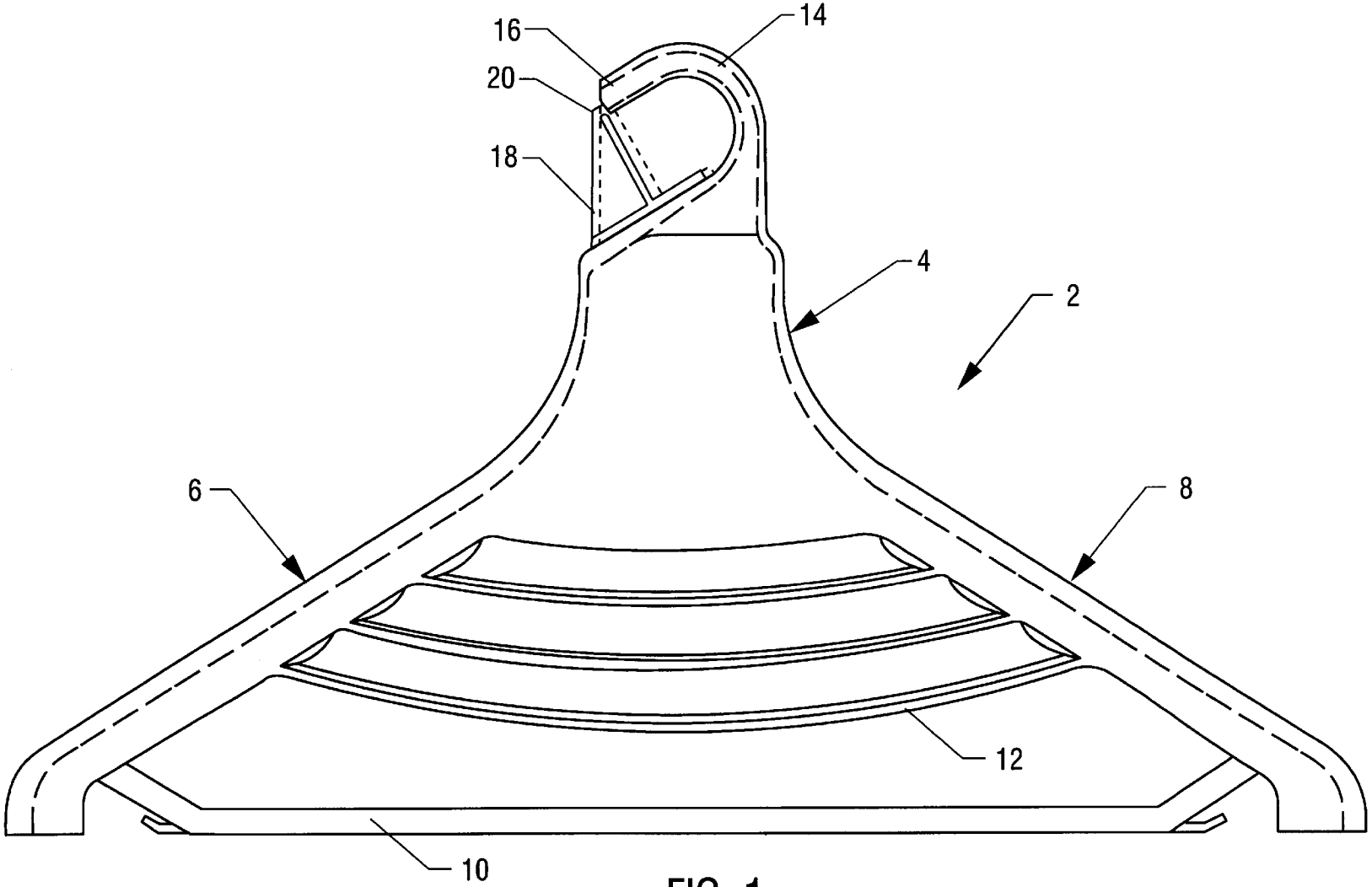
FIG. 1 is a side view of a front side of the garment hanger.

The garment hanger 2 illustrated in FIG. 1 comprises a central body portion 4 integrally formed with suspension shoulders 6 and 8. The free ends of the shoulders 6 and 8 are joined by means of a lower rail 10. A decorative web portion 12 extends between the inner edges of the shoulders 6 and 8. Extending upwardly from the central body portion 4 is a hook 14 which terminates in an end portion 16. A hook closure member 18 is provided and it is movable to a position in which its top edge 20 interlocks with a recess formed in the end portion 16 of the hook 14. The closure member 18 is shown in broken lines in FIG. 1 in its closed position.

Figure 2:
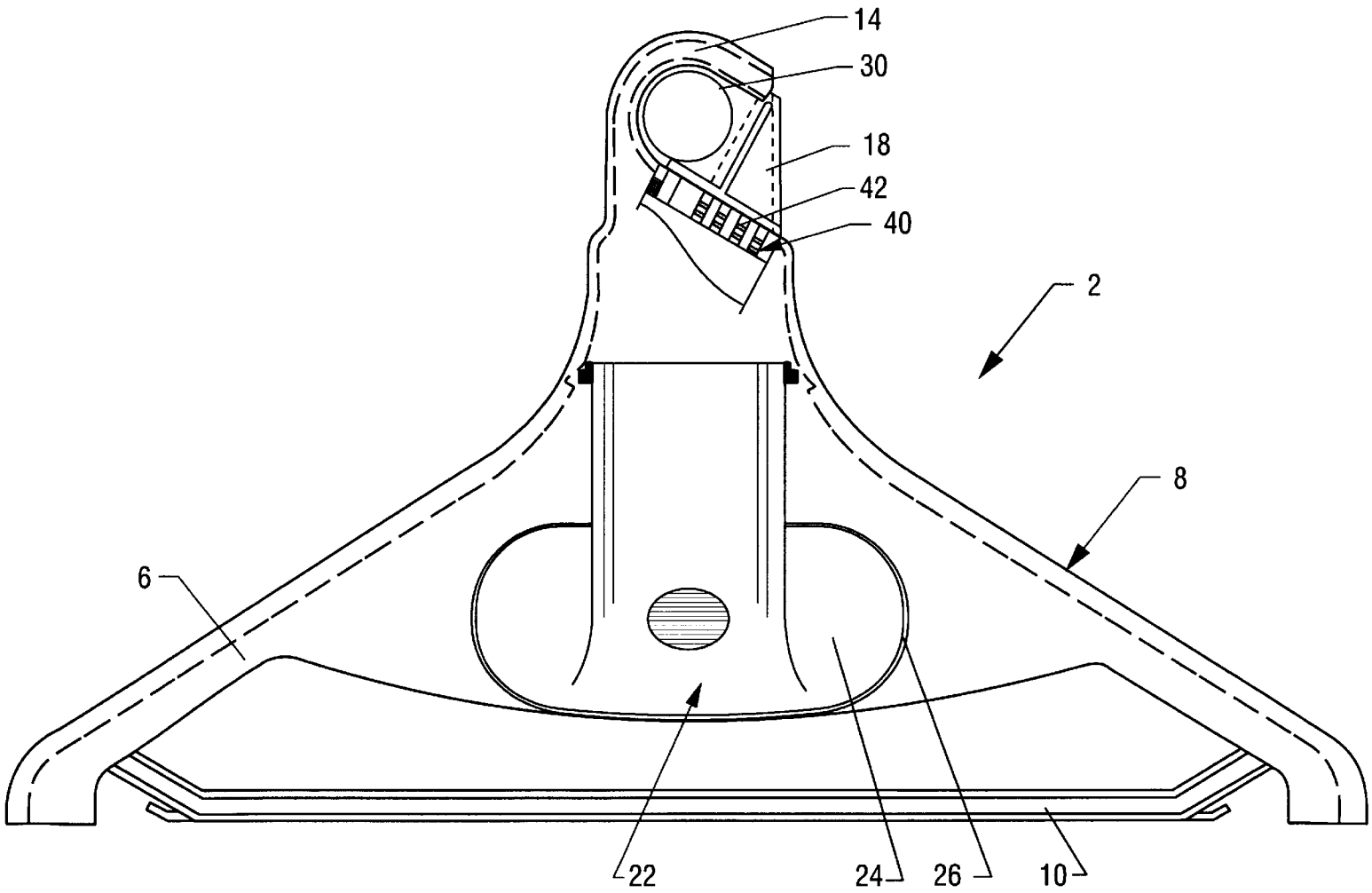
FIG. 2 is a side view of the rear side of the garment hanger.
Figure 8:
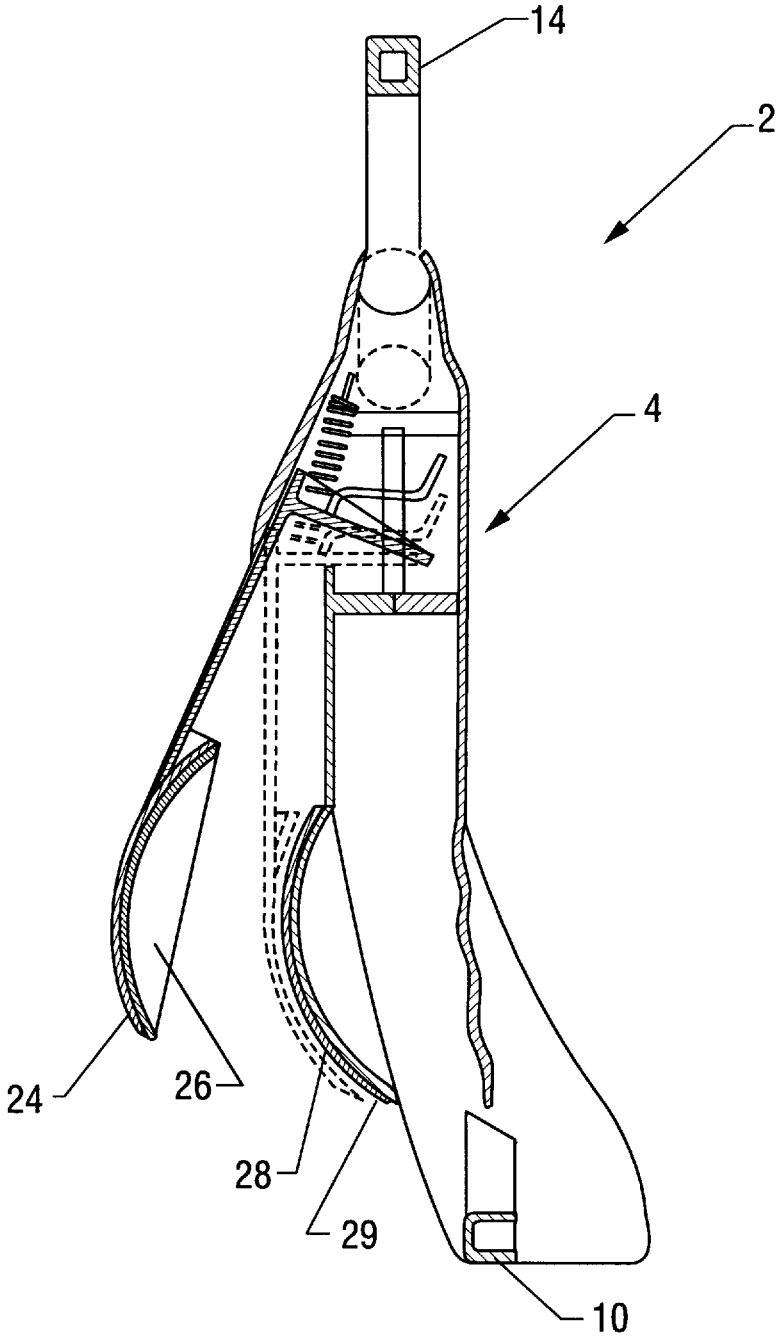
FIG. 8 is a sectional view along the line 8—8.

The hanger 2 includes a retaining arm 22, the upper end of which is pivotally connected to the rear face of the central body 4, as illustrated in FIGS. 2 and 8. The retaining arm 22 terminates in an oval shaped, concave retaining shell 24 which is preferably lined with a layer 26 of non-slip material such as neoprene (see FIG. 8). The shell 24 cooperates with a rounded projection 28 which projects from the web 12 and is of generally complementary shape to the shell 24. The projection 28 is provided with a layer 29 of non-slip material such as neoprene.

When the retaining arm 22 is in its open position, as shown in FIG. 8, a garment can be placed between the arm 22 and the web 12 so that the shoulders 6 and 8 can engage the shoulders of the garment in the usual way. The arm 22 is then pivoted towards the web 12 so that the garment is securely clamped between the shell 24 and projection 28 and their neoprene layers 26 and 29. FIG. 8 shows the arm 22 in its locked position in broken lines. When in this position, it is very difficult if not impossible to remove the garment from the hanger. As will be described hereinafter, when the arm 22 is in its locked position, the closure member 18 is also in its closed position so that the hanger 2 cannot be moved from a hanging rail 30.

Figure 5:
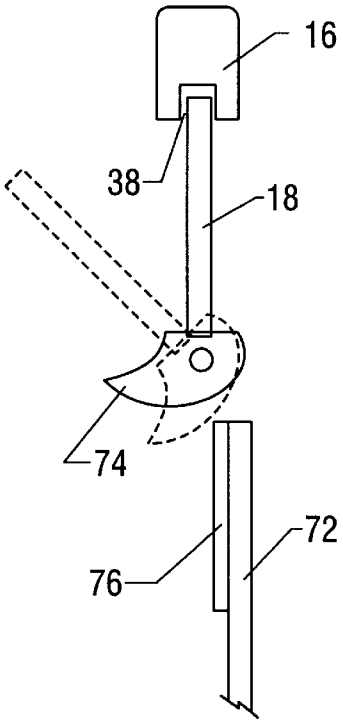
FIG. 5 is a fragmentary view along the line 5—5.
Figure 4:
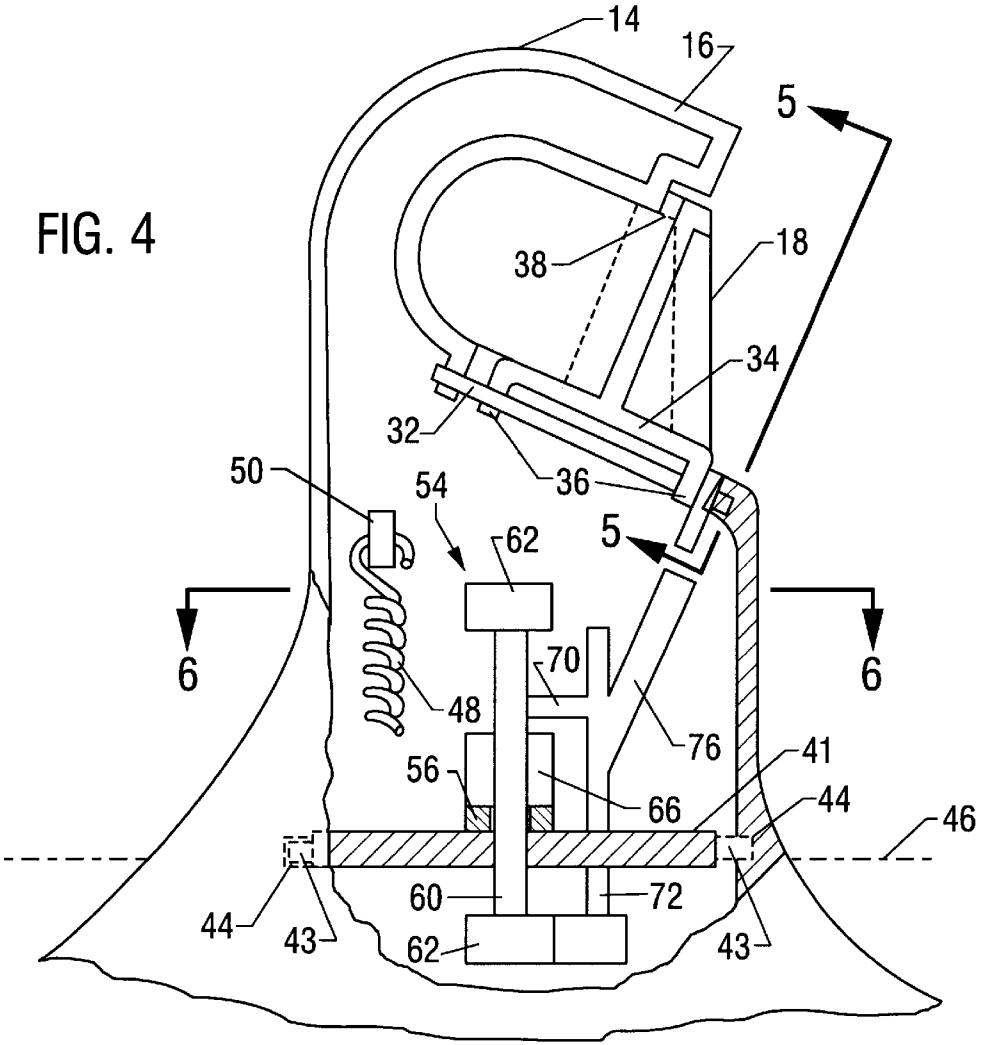
FIG. 4 is a schematic diagram of part of the internal structure of the hanger.

Referring now more particularly to FIGS. 4 and 5, it will be seen that the central body 4 of the hanger is hollow so as to house various components associated with the control of the positions of the closure member 18 and arm 22. The body 4 may include a closure plate (not shown) for providing access to the interior for assembly and/or securing. The coat hanger includes an inclined shaft 32 mounted within the body 4, the closure member 18 is generally triangular in shape and having a base portion 34 from which extend two brackets 36 through which the shaft 32 extends. The closure member 18 is thus slidable along the shaft. In FIG. 4 the closure member 18 is shown in full lines in its open position and broken lines in its closed position. It will be seen that the top edge 20 of the member 18 is located within a recess 38 in the end 16 of the hook 14, when in its closed position. In this position the closure member 18 is held captive in the recess 38 and cannot be rotated relative to the body portion 4 on the shaft 32. Thus the hanger cannot be removed from the hanging rail 30. It will be appreciated that from a functional point of view, the top edge 20 or other part of the member 18 need only be locked in a position relative to the hook 14 such that the hanging rail 30 cannot pass between the hook and the closure member 18.

Figure 3:
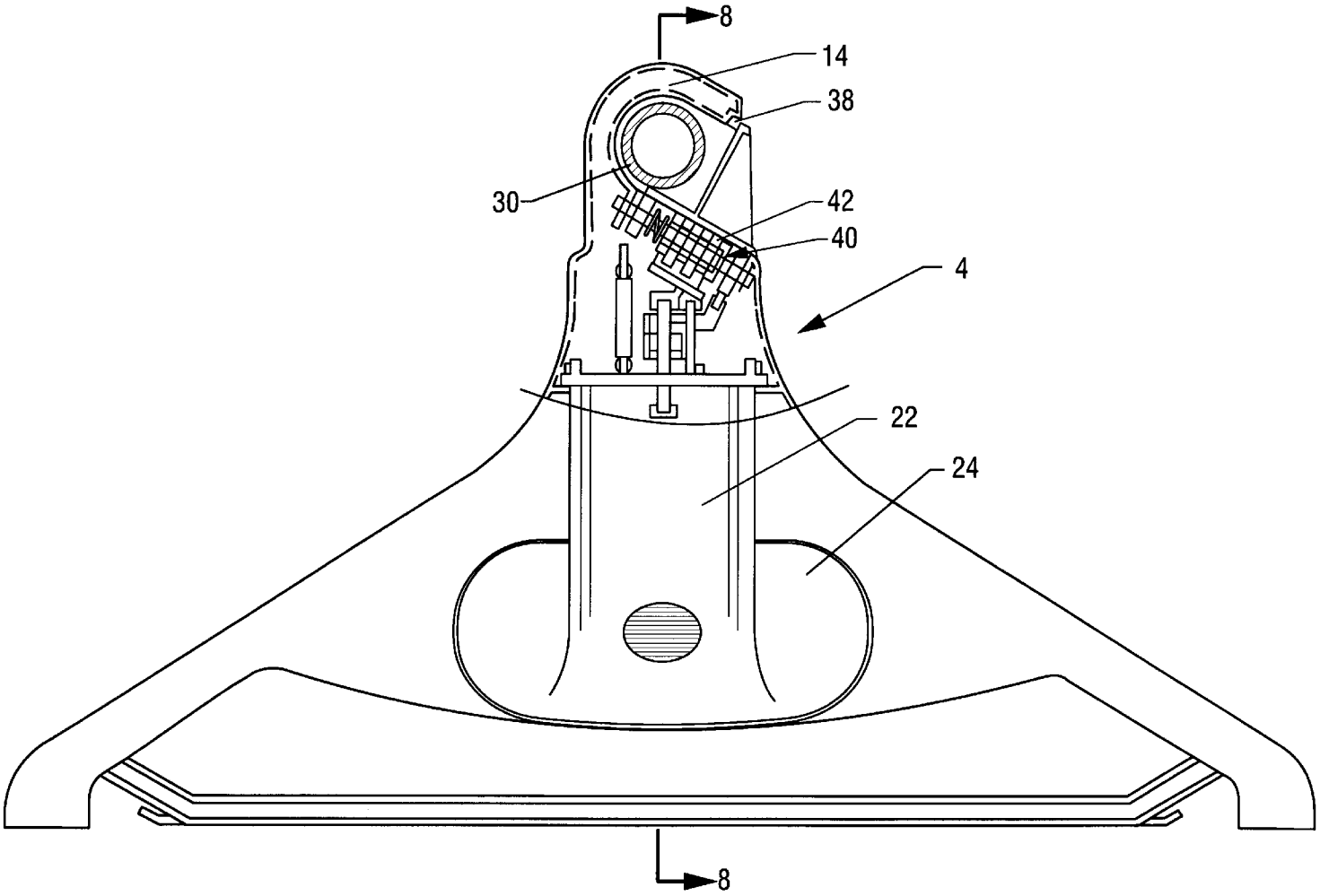
FIG. 3 is a rear view of the garment hanger partly in section.

As best seen in FIGS. 2 and 3, a combination lock 40 is mounted on the shaft 32. The combination lock 40 is provided with index wheels 42 which are accessible from the rear face of the garment hanger as seen in FIG. 2. When the user selects the correct numbers indicated on the index wheels 42, the lock 40 permits the closure member 18 to be moved from its closed position to an open position in which it is clear of the recess 38. In this position it can be rotated about the shaft 32 so that the hanger can be removed from the rail 30. The details of the lock 40 and the index wheels 42 need not be described since these are commonly known and are commercially available.

Figure 10:
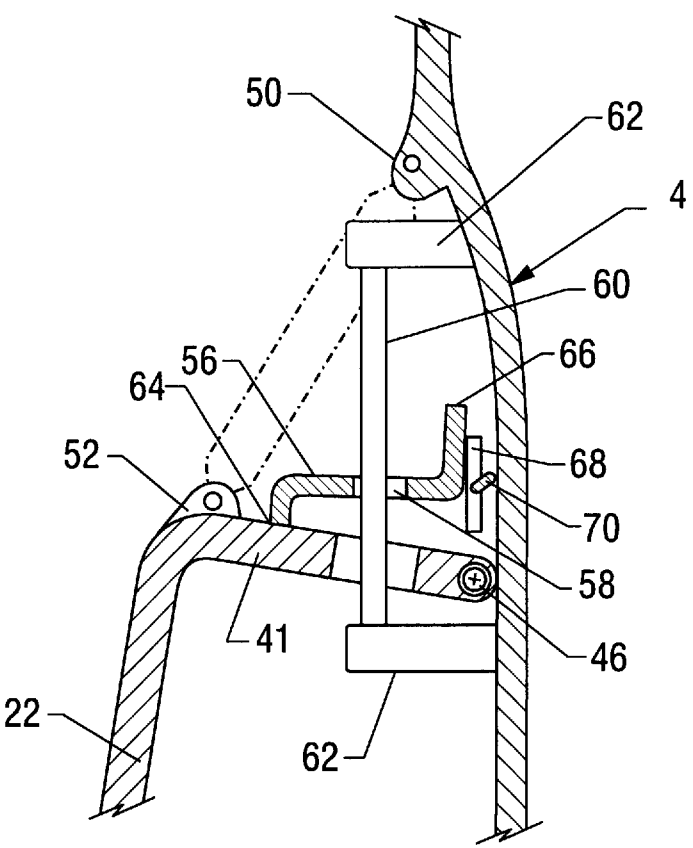
FIG. 10 is a fragmentary sectional view with the retaining member in its open position.
Figure 9:
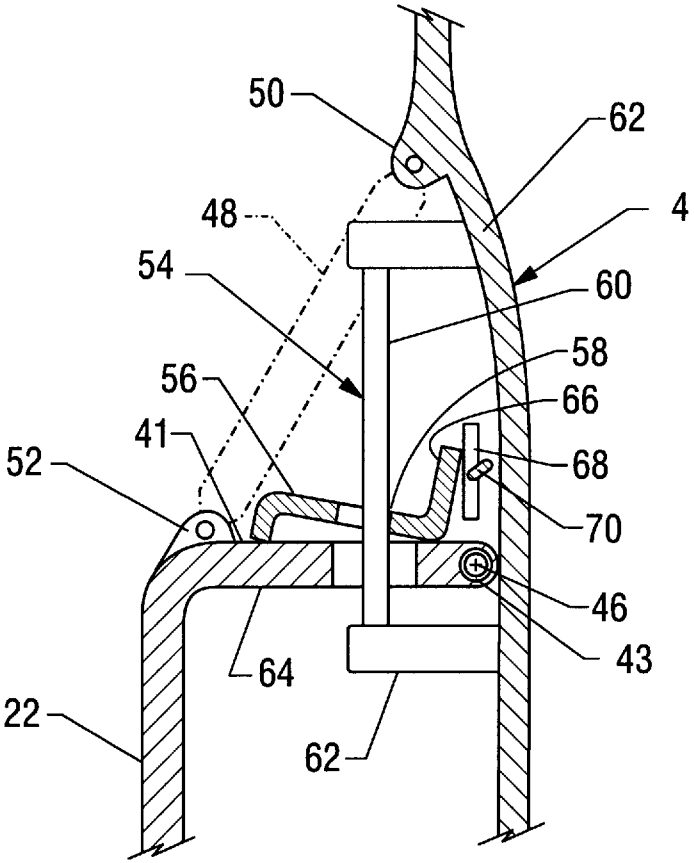
FIG. 9 is a fragmentary sectional view with the retaining member in its closed position.

The arm 22 is provided with an inwardly directed mounting plate 41 which is provided with a pair of laterally extending pivot lugs 43. The pivot lugs 43 are received within recesses 44 formed in the internal walls of the body portion 4 to enable the arm 22 to pivot about an axis 46 between its open and closed positions. A tension spring 48 is provided so as to bias the arm 22 to its open position. As best seen in FIGS. 9 and 10, one end of the spring 48 is pivoted to a bracket 50 formed on an internal wall of the central body 4 and the other end of the spring 48 is connected to a bracket 52 which projects upwardly from the mounting plate 41 of the arm 22. This biases the arm 22 into its open position, as seen in FIG. 8.

A release mechanism 54 is coupled between the closure member 18 and the arm 22 so as to prevent the arm 22 moving from its closed position to its open position until such time as the closure member 18 has been rotated on the shaft to an open position (in which it is rotated approximately through 90° on the shaft 32).

Figure 6:
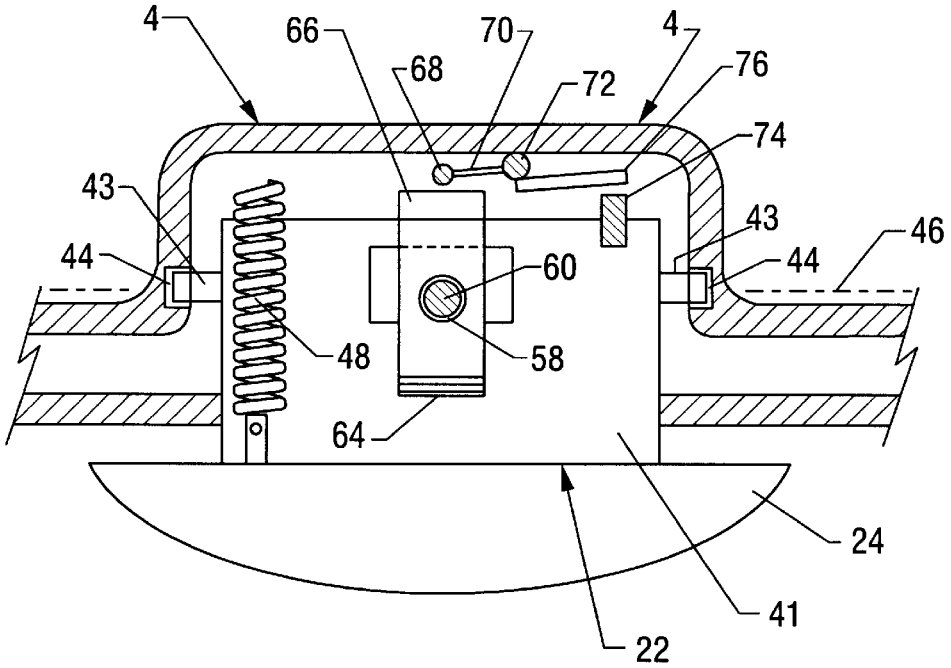
FIG. 6 is a partial cross-sectional view along the line 6—6.
Figure 7:
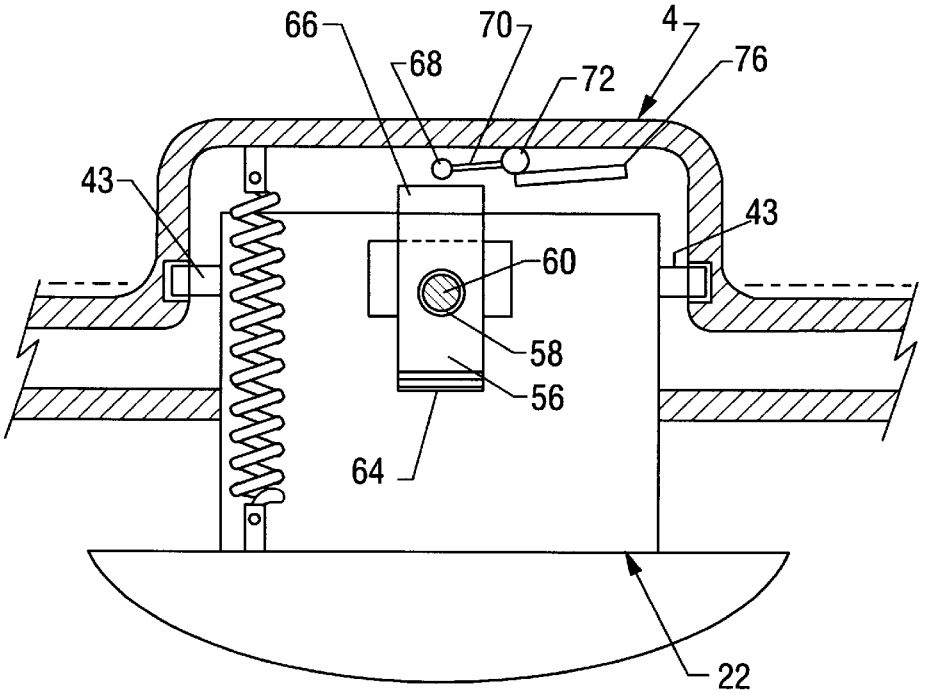
FIG. 7 is a partial sectional view with the retaining member in its open position.

The release mechanism 54 comprises a locking plate 56 which is provided with a bore 58 for sliding movement along a locking shaft 60. The ends of the locking shaft 60 are supported by mounting brackets 62 which project inwardly from the body portion 4. The locking shaft 60 passes through an opening 61 in the mounting plate 41. The bore 58 of the locking plate 56 is slightly larger than the diameter of the shaft 60 and the arrangement is such that when the plate 56 is inclined relative to the axis of the shaft 60 the adjacent edges of the bore 58 tend to bite into and lock on the shaft 60. When, however, the locking plate 56 is in a position in which it is generally transverse to the axis of the shaft 60, as seen in FIG. 9, it is free to rotate to a limited extent along the shaft 60. The locking plate 56 is provided with a downturned flange 64 which engages the mounting plate 41 of the arm 22, as seen in FIG. 9. When the hanger is in its closed position, as shown in FIG. 9, the plate 56 will be inclined relative to the shaft 60 and will therefore be locked relative to the shaft as hereinbefore described. If there is any unauthorised attempt to open the arm 22 by simply rotating it, this movement will be restrained by engagement of the mounting plate 41 with the flange 64 of the plate 56. The release mechanism 54 thus holds the arm 22 in its locked position. In order to operate the release mechanism 54 a mechanism is provided to rotate the plate 56 so that it can move up the shaft 60 whereby the arm 22 can be rotated, as seen in FIG. 10. For this purpose, the inner end of the locking plate 56 includes an upstanding leg 66 which is adjacent to a finger 68 which in turn is mounted on an arm 70 which is carried by a shaft 72 mounted for rotation in the body 4, as seen in FIGS. 6, 9 and 10. When the shaft 72 is rotated (anti-clockwise as seen in FIG. 6) the finger 68 comes into engagement with the leg 66 thereby moving the plate 56 to a position in which it is generally transverse to the shaft 60. In this position it can move up the shaft 60 to its release position as shown in FIG. 10. Rotation of the shaft 72 is effected by means of engagement of a cam 74 which is integrally formed or connected to the closure member 18, as seen in FIG. 5. When the closure member 18 rotates on the shaft 32, the cam 74 will rotate into engagement with an arm 76 which projects from the shaft 72 in the opposite direction to the arm 70. Engagement of the cam 74 with the arm 76 will cause the aforementioned rotation of the shaft 72 and consequential movement of the locking plate 56.

The operation of the hanger of the invention is as follows. With the arm 22 and closure member 18 in their open positions, a garment is placed upon the shoulders 6 and 8. The arm 22 is then rotated into engagement with a shoulder portion of the garment so that it is clamped between the shell 24 and projection 28. During this movement, the locking plate 56 will move along the shaft 60 until it assumes its locked position as shown in FIG. 9. As described above, it cannot be moved from this position by rotation of the arm 22 by virtue of the engagement of the edges of the bore 58 with the shaft 60. The hook 14 is then placed on the rail 30 and the closure member 18 is rotated so that it is generally aligned with the plane of the hook 14. It is then slid along the shaft 32 until its top edge 20 enters the recess 38 where it is held captive against further rotation. The user then operates the index wheels 42 of the combination lock 40 so as to effectively lock the closure member 18 in a locked condition. It will remain in this condition until the user selects the correct combination of numbers on the index wheels 42 to permit downward sliding movement of the closure member 18 on the shaft 32. This of course is done when an authorised removal of the garment is required.

Once the retaining member has been moved along the shaft 32 it can then be rotated so that its cam 74 engages the arm 76. This causes a consequential engagement of the finger 68 with the upstanding leg 66 of the locking plate 56 to thereby permit the arm 22 to swing upwardly to its open position under the influence of the spring 48 to its open position as shown in FIG. 10. The opening 61 in the mounting plate 41 has sufficient clearance from the locking shaft 60 to permit this rotation. The garment can then be removed from the hanger in the usual way.

Figure 11:
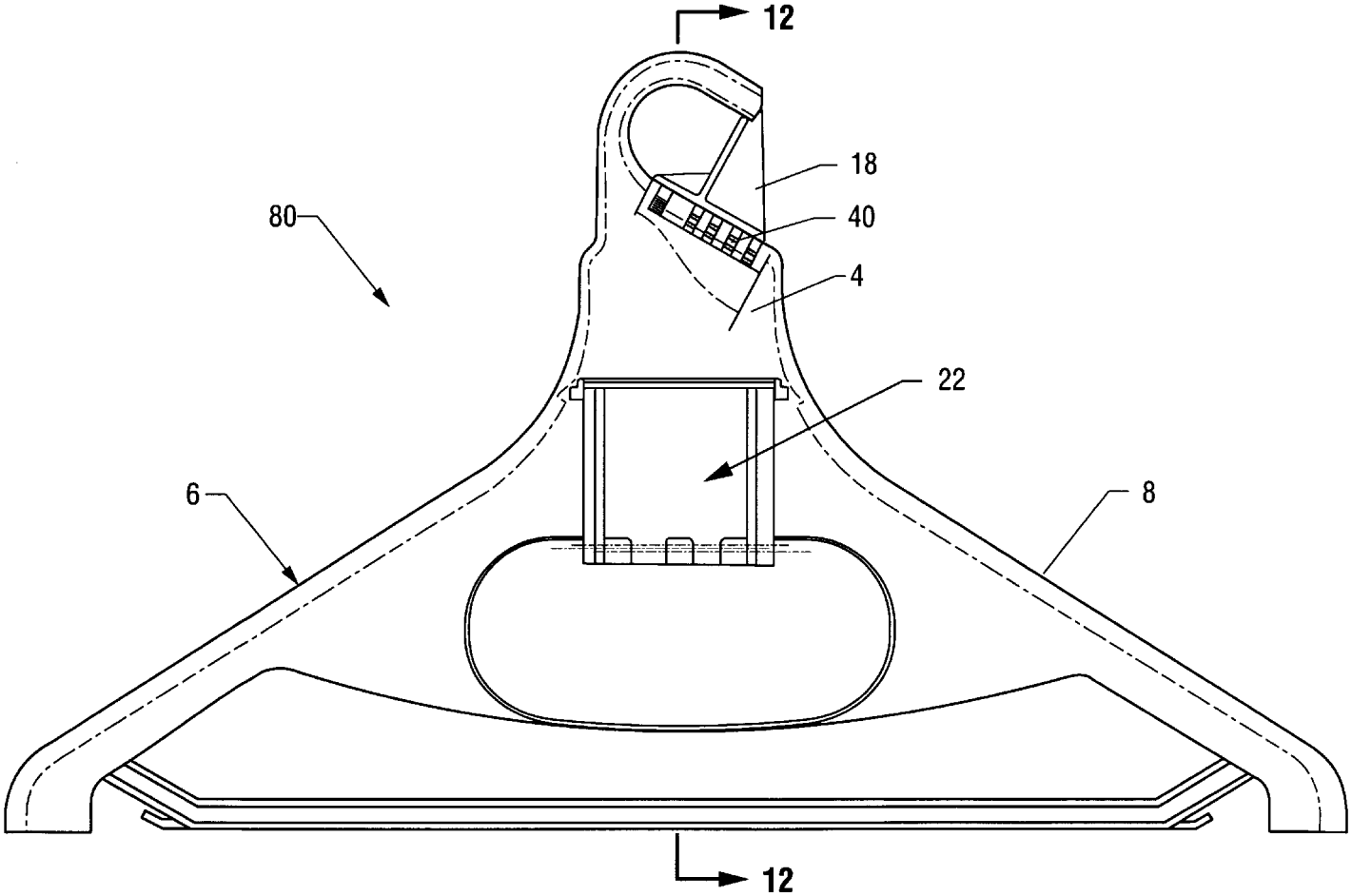
FIG. 11 is a view of the rear side of an alternative embodiment of the invention.
Figure 12:
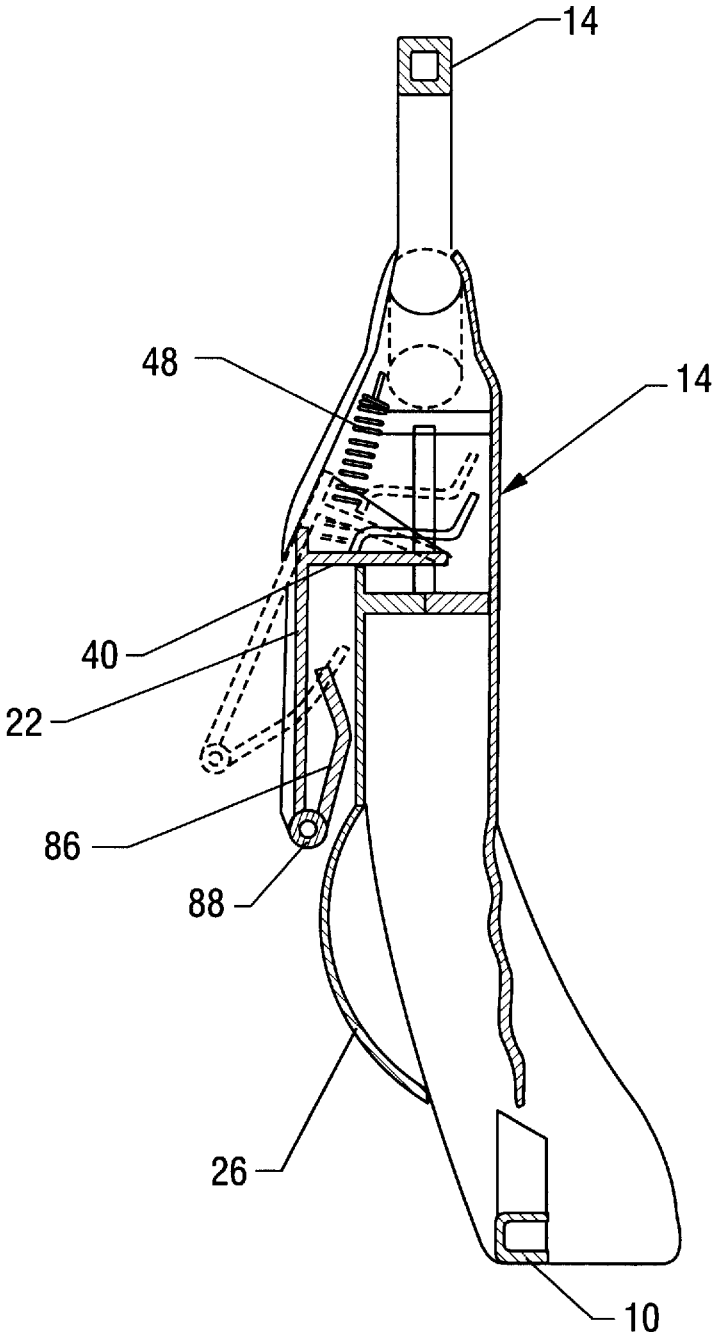
FIG. 12 is a sectional view along the line 12—12.
Figure 13:
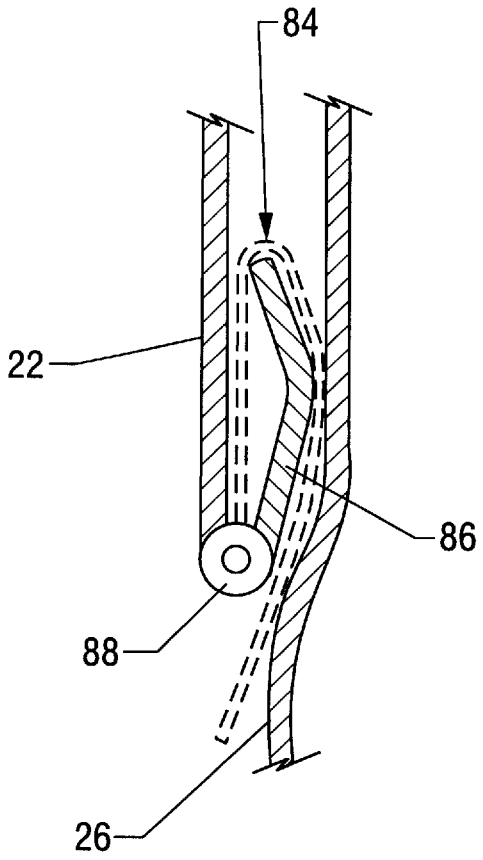
FIG. 13 is a more detailed fragmentary view showing how the hanger of FIGS. 11 and 12 interlocks with the collar of a garment.

FIGS. 11, 12 and 13 illustrate a modified form of security garment hanger of the invention. In these drawings the same reference numerals are used to denote parts which are the same as or correspond to those of the previous embodiment. The main difference between the garment hanger 80 illustrated in FIGS. 11 to 13 is that it has a modified form of retaining arm 22. In this embodiment, the arm 22 is shorter and terminates in a terminal hook portion 86 which is connected to the arm 22 by means of a hinge 88. The shell 24 in this embodiment is omitted.

In this embodiment, the terminal hook portion 86 is fitted under the fold of the collar 84 as shown in FIG. 13 and the arm 22 is pressed inwardly so that the collar 84 of the garment is sandwiched between the arm 22 and the terminal hook portion 86 and between the terminal hook portion 86 and the adjacent part of the hanger body and/or the terminal hook portion 86. The remainder of the hanger functions in exactly the same way as in the previous embodiment.

Many modifications will be apparent to those skilled in the art without departing from the spirit and scope of the invention.

We claim:

1. A security garment hanger (2) comprising a body portion (4), a hook (14) extending from the body portion, garment clamping means (24,28) mounted for movement between an open position and a clamped position in which in use a garment is clamped between the garment clamping means and the body portion, a hook closure member (18) which is mounted for rotational movement relative to the body portion from a closed position in which a first part of the hook closure member engages or is adjacent to the hook and an open position in which the first part (20) of the hook closure member is clear of the hook whereby, in use, the hook can be removed from a hanging rail (30), a lock (40) for locking the hook closure member in its closed position, and interlocking means (56,60) coupled between the hook closure member and the garment clamping means and being operable whilst the hook closure member is in its closed position to retain the garment clamping means in its clamped position.

2. A security garment hanger as claimed in claim 1 wherein the hook closure member is mounted on a shaft (32) for rotation thereon and for sliding movement thereon, and wherein in said closed position said first part engages a recess (38) in said hook and wherein upon release of said lock, the hook closure member can slide along the shaft so that the first part disengages said recess and then be rotated to its open position.

3. A security garment hanger as claimed in claim 2 wherein the lock comprises a combination lock.

4. A security garment hanger as claimed in claim 1 wherein the interlocking means includes a locking shaft (60) and a locking plate (56) having a bore therein through which the locking shaft passes, the arrangement being such that, in a locked position of the locking plate, movement of the garment clamping means from its clamped position towards its open position is resisted by the locking plate.

5. A security garment hanger as claimed in claim 4 wherein the interlocking means includes actuating means (68) which is operable to cause rotational movement of the locking plate to a release position in which it can slide along the locking shaft thereby permitting the garment clamping means to move to its open position.

6. A security garment hanger as claimed in claim 5 wherein the interlocking means includes a pivot member (70,72,76) which is mounted for pivotal movement relative to the body portion, and wherein the hook closure member includes a cam which, when the hook closure member moves to its open position, causes rotational movement of the pivot member which, in turn, causes said rotational movement of the locking plate.

7. A security garment hanger as claimed in claim 6 including biasing means to bias the garment clamping means towards its open position.

8. A security garment hanger as claimed in claim 7 wherein the biasing means comprises a tension spring acting between the body portion and the garment clamping means.

9. A security garment hanger as claimed in claim 8 wherein the garment clamping means comprises an arm pivotally connected to the body portion.

10. A security garment hanger as claimed in claim 9 wherein a free end of the arm includes first garment gripping means (24,26) for cooperating with second garment gripping means (28,29) formed on the body portion.

11. A security garment hanger as claimed in claim 10 wherein the arm is pivotally connected to the body portion by a mounting plate (41), said mounting plate including an opening (61) through which the locking shaft passes and wherein the locking plate (56) coacts between the mounting plate and the locking shaft.

12. A security garment hanger as claimed in claim 11 wherein the mounting plate includes a central portion which contains said bore, a downturned flange (64) which is engageable with the mounting plate (41) and an upstanding leg (66) which is engageable by said pivot member (68).

13. A security garment hanger as claimed in claim 9 wherein the arm has a terminal hook portion (86) pivotally connected thereto for cooperation with the collar (84) of a garment.

14. A security garment hanger (2) comprising a body portion (4), a hook (14) extending from the body portion, garment clamping means (24,28) mounted for movement between an open position and a clamped position in which in use a garment is clamped between the garment clamping means and the body portion, a hook closure member (18) which is mounted for rotational movement relative to the body portion from a closed position in which a first part of the hook closure member engages or is adjacent to the hook and an open position in which the first part (20) of the hook closure member is clear of the hook whereby, in use, the hook can be removed from a hanging rail (30), a lock (40) for locking the hook closure member in its closed position, and interlocking means (56,60) operable whilst the hook closure member is in its closed position to retain the garment clamping means in its clamped position, and wherein the hook closure member is mounted on a shaft (32) for rotation thereon and for sliding movement thereon, and wherein in said closed position said first part engages a recess (38) in said hook and wherein upon release of said lock, the hook closure member can slide along the shaft so that the first part disengages said recess and then be rotated to its open position.

15. A security garment hanger comprising a hanger body including suspension members upon which a garment can be hung, a hook member for suspending the body from an elongate rail, said garment hanger including a closure member which is movable relative to the hanger body between an open position in which the hook member can be coupled to or uncoupled from said rail and garment clamping means for preventing removal of the garment from the suspension members and wherein the garment clamping means comprises an arm pivotally connected to the body means for rotation about an axis which in use is beneath and perpendicular to said elongate rail, said arm being movable to a clamped position in which it lies adjacent to a projecting portion of the body which lies between said suspension members.

* * * * *